US007490731B2

(12) United States Patent
Hautop

(10) Patent No.: US 7,490,731 B2
(45) Date of Patent: Feb. 17, 2009

(54) SANITARY NAPKIN DISPOSAL ASSEMBLY

(76) Inventor: Julie A Hautop, 9 Perin Avenue, Woodcroft, South Australia 5162 (AU)

( * ) Notice: Subject to any disclaimer, the term of this patent is extended or adjusted under 35 U.S.C. 154(b) by 708 days.

(21) Appl. No.: 10/546,007

(22) PCT Filed: Feb. 20, 2004

(86) PCT No.: PCT/AU2004/000198

§ 371 (c)(1),
(2), (4) Date: Aug. 31, 2005

(87) PCT Pub. No.: WO2004/074137

PCT Pub. Date: Sep. 2, 2004

(65) Prior Publication Data

US 2006/0106358 A1 May 18, 2006

(30) Foreign Application Priority Data

Feb. 21, 2003 (AU) ..... 2003900951

(51) Int. Cl.
*B65F 1/06* (2006.01)

(52) U.S. Cl. ..... 220/495.1; 220/908.1; 220/495.08

(58) Field of Classification Search ..... None
See application file for complete search history.

(56) References Cited

U.S. PATENT DOCUMENTS

| | | | | | |
|---|---|---|---|---|---|
| 2,192,896 | A * | 3/1940 | Corson | ..... | 15/142 |
| 5,127,538 | A * | 7/1992 | Bach | ..... | 220/529 |
| 6,128,890 | A * | 10/2000 | Firth | ..... | 53/567 |

FOREIGN PATENT DOCUMENTS

| | | |
|---|---|---|
| CA | 2 224 955 A1 | 7/1999 |
| JP | A-2000-247401 | 9/2000 |
| WO | WO 99/39995 A1 | 8/1999 |

* cited by examiner

*Primary Examiner*—Stephen Castellano
(74) *Attorney, Agent, or Firm*—Oliff & Berridge, PLC

(57) ABSTRACT

A sanitary napkin disposal assembly including a cartridge having an internal storage compartment with an opening at one end, with retaining means for supporting a bag within the storage compartment. There is a rod having an open position, in which a top surface of the rod is accessible, and a closed position in which said rod is housed within the storage compartment, such that when a sanitary napkin is disposed of by being placed on the top surface of the rod in the open position, with the bag subsequently unfolding in a longitudinal extending action into the storage compartment, with the retaining means capturing the sanitary napkin therein the bag, as the rod moves to the closed position.

22 Claims, 16 Drawing Sheets

SANITARY NAPKIN DISPOSAL ASSEMBLY

TECHNICAL FIELD

This invention relates to a disposal assembly for the hygienic disposal of sanitary napkins and the like.

BACKGROUND ART

A problem often arises when a user of a toilet requires to dispose of a sanitary napkin but is left with no appropriate means to do so. It is not possible to flush the napkin down the toilet, as such items have a tendency of blocking the sewerage pipes.

In some instances to avoid the problem of pipe blockage, the sanitary napkin is disposed of in a standard waste bin, that is normally found in most bathrooms and public washroom facilities. Nonetheless, this disposal of the sanitary napkin into the waste bin presents its own problems, including that of foul odors and public health, as the sanitary napkin has the potential to become a source of infection and disease once soiled.

Further, disposing of the sanitary napkin in the waste bin creates an unsightly and perhaps embarrassing situation for a subsequent user of the bathroom, especially if the waste bin is of the type without a lid.

Previously, to deal with these problems discussed above, special receptacle containers separate from the standard waste bin, were installed in the bathroom. These specially provided for containers are characterized by being of a relatively elongated rectangular shape. The container is normally floor-standing and with a flip-top flap which is lifted open to deposit the sanitary napkin into the container.

Such containers however do not provide a secure or controlled environment for the disposal of the sanitary napkin. The lid of the container is easily left open once the deposit of the sanitary napkin has taken place.

Further, such containers are of relatively large dimensions, so as to accommodate adequate amounts of napkins. This bulky size tends to clutter up space in the bathroom.

These types of containers are required to be of such dimensions, as there is no effort made in the container to compress the sanitary items together. As the sanitary napkins are not compressed together there tends to be an excessive volume of waste within the container.

A still further problem with these containers, is that the disposal bag in which the sanitary napkins will be deposited needs to be correctly aligned within the container. This lining of the disposal bag within the container may require some skill by the user, and at least has the potential to expose, those lining the bag to foul odours or bacteria found within the container.

Therefore, there still remains a need within the art for a sanitary disposal assembly that avoids the problems discussed above.

Hence, an object of this invention is to overcome or at least substantially ameliorate some of the shortcomings discussed above of sanitary disposal assemblies, or at least provide the public with a sanitary disposal assembly that is a useful alternative to existing disposal arrangements that are available.

DISCLOSURE OF THE INVENTION

Accordingly there is provided a sanitary napkin disposal assembly, said assembly including:

a cartridge having an internal storage compartment with an opening at one end, with retaining means for supporting a bag within the storage compartment;

a rod having an open position, in which a top surface of said rod is accessible, and a closed position in which said rod is housed within the storage compartment;

such that when a sanitary napkin is disposed of by being placed on the top surface of the rod in the open position, with the bag subsequently unfolding in a longitudinal extending action into the storage compartment, with the retaining means capturing the sanitary napkin therein the bag, as the rod moves to the closed position.

An advantage of such an arrangement is that the sanitary napkin is no longer exposed within the bathroom, as the napkin is inserted up into the disposal bag within the cartridge, avoiding the need to flush the item down the toilet or dispose of in the waste bin.

Preferably the cartridge is removably attached to the rod and the rod is in a fixed position. In preference the rod is fixed to the floor of the bathroom or the public washroom facility.

An advantage of such an arrangement of the sanitary napkin disposal assembly having the rod fixed to the floor, is that a user of the assembly, requires only to move the cartridge away from the rod to create the open position to which the sanitary napkin may then be deposited. There is no requirement to first fix in place the rod.

In preference, the sanitary napkin disposal assembly further includes a slide-able sleeve mounted around an exterior surface of the cartridge, wherein the sleeve and the cartridge are provided with securing means, formed integrally with respective to the sleeve and cartridge.

Preferably the sleeve includes an encircling flange at an upper internal perimeter. The flange includes a partition groove along the flange length adapted to receive an outwardly extended tab protruding from the cartridge. A rotation of the cartridge relative to the sleeve brings the tab into cooperation with the groove and with vertical applied movement the tab is able to pass through the groove, and with further rotation abuts a shoulder of the flange for releasable securement of the sleeve to the cartridge.

Preferably the sleeve includes an internal collar around the base of the sleeve. The collar accommodates an abutting fit with a top peripheral edge of the cartridge.

An advantage of such an arrangement of having the sleeve mountable to the cartridge is that the unfolded portion of the disposable bag, that has not been inserted into the storage compartment of the cartridge, no longer remains exposed This avoids any inadvertent tampering with the disposal bag when the sanitary napkin disposal assembly is in use.

Preferably the sleeve includes a skirt that laterally extends out from a portion at the base of the sleeve. In preference a lip longitudinally extends in a substantially parallel direction as that of the sleeve from the skirt, such that when the rod is in the open position, an interior panel of the lip provides for an accessible containment space with the top cover of the rod for the positioning of the sanitary napkin on the rod.

An advantage of such an arrangement is that it allows a relatively simplistic positioning of the sanitary napkin on the rod. A further advantage is that the lip prevents the sanitary napkin from falling off the top cover of the rod. The interior panel of the lip acts as a barrier around the region where the sanitary napkin will be deposited.

Preferably the cartridge includes a handle at the end opposite the opening into the storage compartment. The handle can be grasped by a user, such that the cartridge is conveniently slideably removable from the rod, to provide the opening and closing positions of the rod with respect to the cartridge.

Preferably the handle is integral with the cartridge.

Preferably the retaining means includes two separate panels extended from opposing sides of an interior wall of the cartridge. Preferably the panels are supported by a plurality of resilient strips.

In preference, these plurality of resilient strips maintain each panel in an inwardly inclined orientation, such that a forward end of each panel is separable from the other, as the rod is inserted into the open end of the cartridge. While the rod is in the open position the two panels remain in a pointed seat arrangement.

An advantage of such an arrangement is that the retaining means allows for unimpeded movement of the rod into the cartridge, but when the rod is in the open position the two panels, though no longer in the pointed seat arrangement provide for a closure mechanism, preventing any captured sanitary napkins within the disposable bag, from being ejected from the storage compartment back out into the bathroom.

Preferably the sanitary napkin disposal assembly further includes an external casing formed separately from the cartridge and the rod.

In preference the casing is substantially cylindrical and of the same general outer dimensions as the sleeve when mounted to the cartridge.

Preferably, the casing is fixed to the floor and includes a shoulder that runs completely around the upper peripheral rim of the underside of the casing. The shoulder is of sufficient width so as to abut the laterally extended skirt extended around a portion, at the base of the sleeve.

An advantage of such an arrangement is that as the cartridge is withdrawn away from the rod, the cartridge movement relative to the rod is restricted. The shoulder on the underside of the casing abuts the skirt of the sleeve preventing further movement. This avoids the inadvertent separation of the cartridge with respect to the rod.

A still further advantage of the casing is that the casing provides an overall neat appearance of the assembly, by containing all components compactly and neatly in the one assembly.

A still further advantage of the casing is that as the cartridge is withdrawn from 30 the rod, the abutment between the shoulder of the casing and the skirt of the sleeve allows for convenient and automatic definable spacing of the area required to deposit the sanitary napkin on the rod by the user.

Preferably, the sanitary napkin disposal assembly includes corresponding transparent slits that run along the length of the casing, sleeve and cartridge.

An advantage of such an arrangement is that as the cartridge fills with the sanitary napkins, the sleeve and cartridge remain at a higher vertical position relative to the casing.

Embodiments of the invention are now described in detail in the following passages of the specification and referred to in the accompanying drawings. The drawings and description however, are merely illustrative of how the invention might be put into effect, so that the specific form and arrangement of the features shown in the description, are not to be understood as limiting of the invention.

MODES OF CARRYING OUT THE INVENTION

Figure 1:
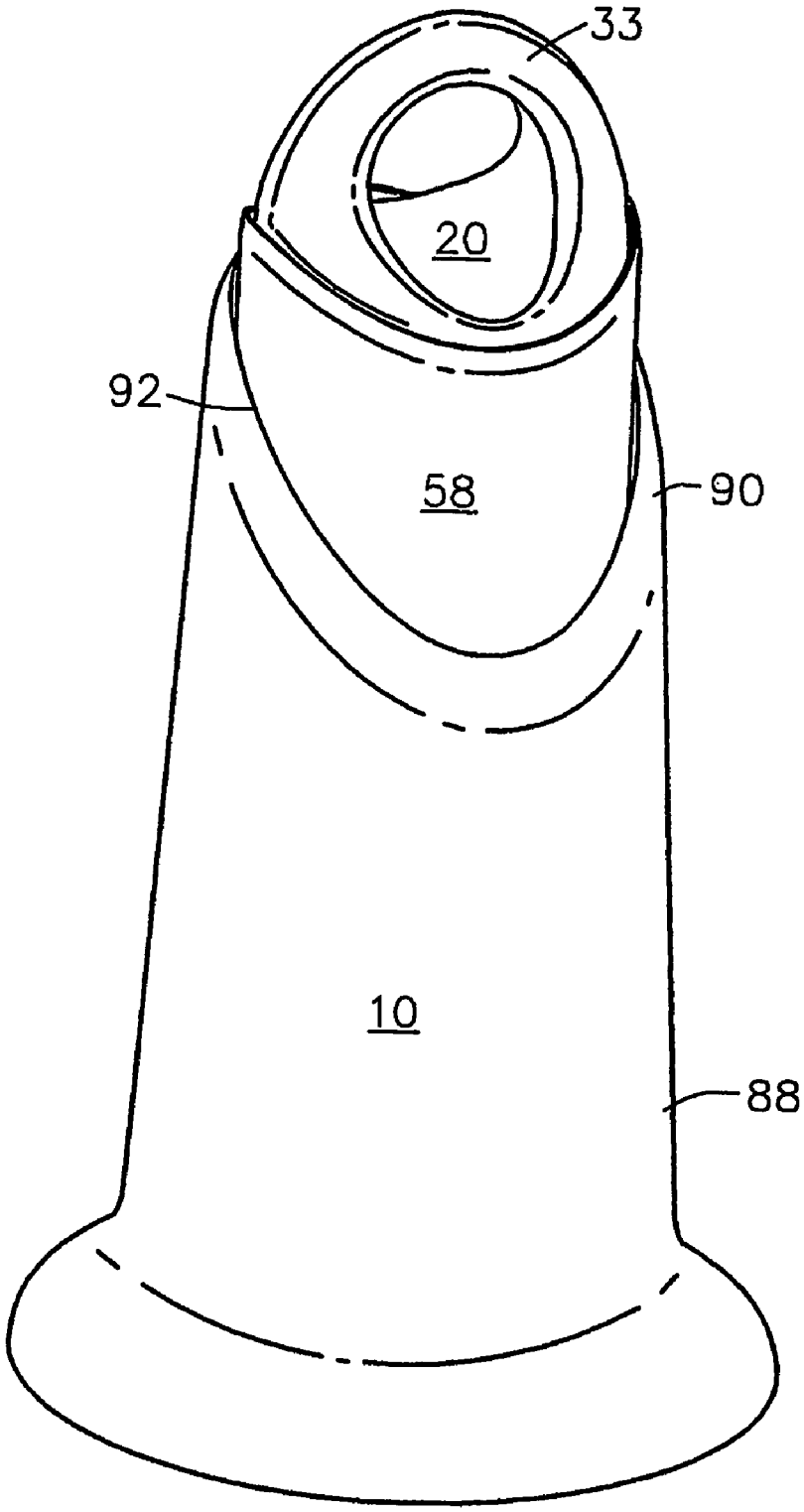
FIG. 1 is a perspective view of the sanitary napkin disposal assembly for a preferred embodiment of the invention, with the assembly in the closed position.
Figure 2:
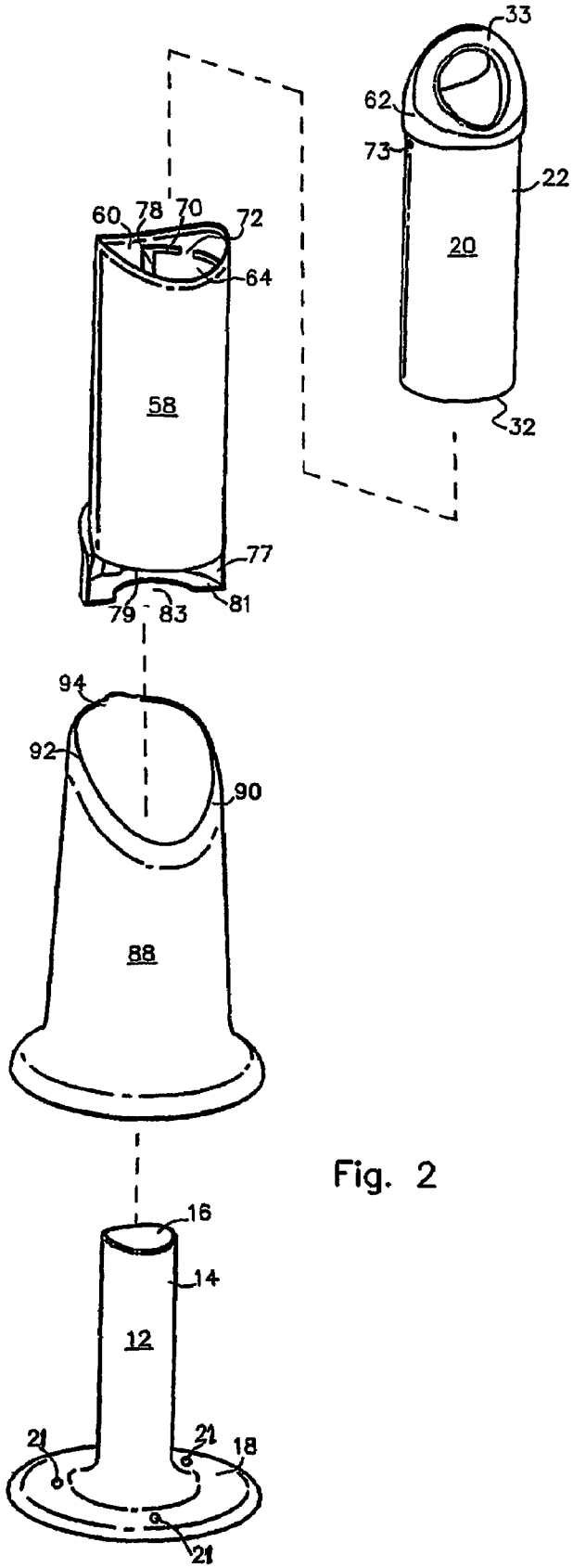
FIG. 2 is an exploded view of FIG. 1.
Figure 3:
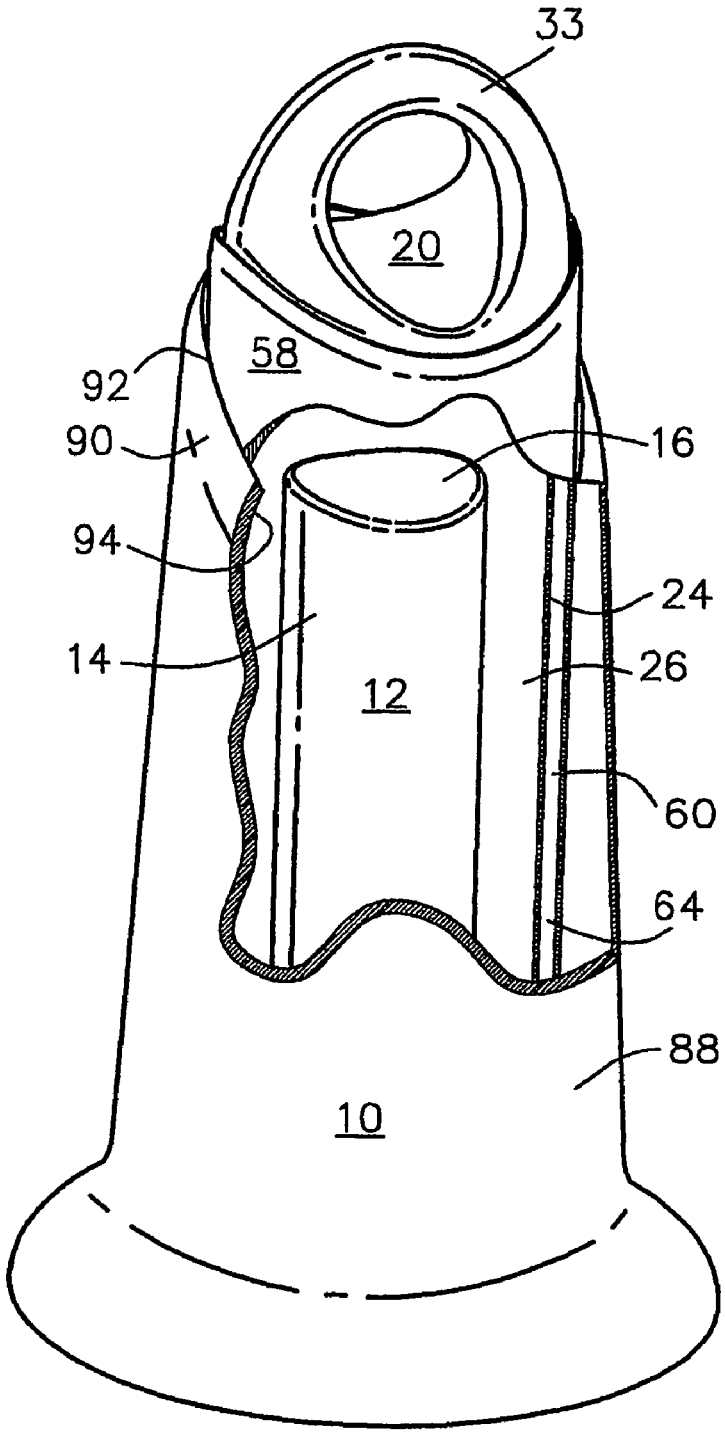
FIG. 3 is a fragmentary view of part of FIG. 1 showing the rod inserted into the cartridge.
Figure 4:
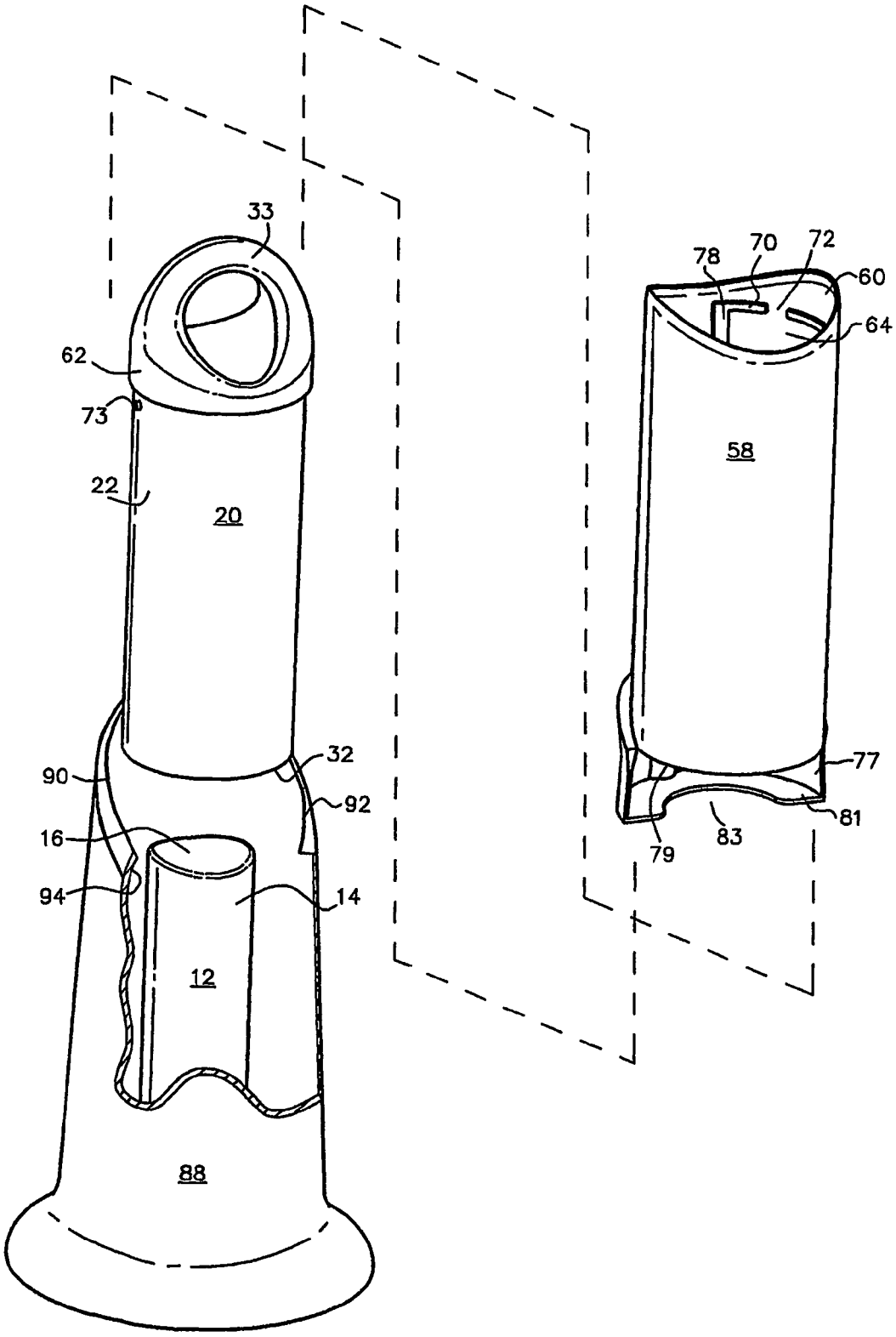
FIG. 4 is an exploded view of part of FIG. 3, of the rod in the open position with respect to the cartridge.
Figure 5:
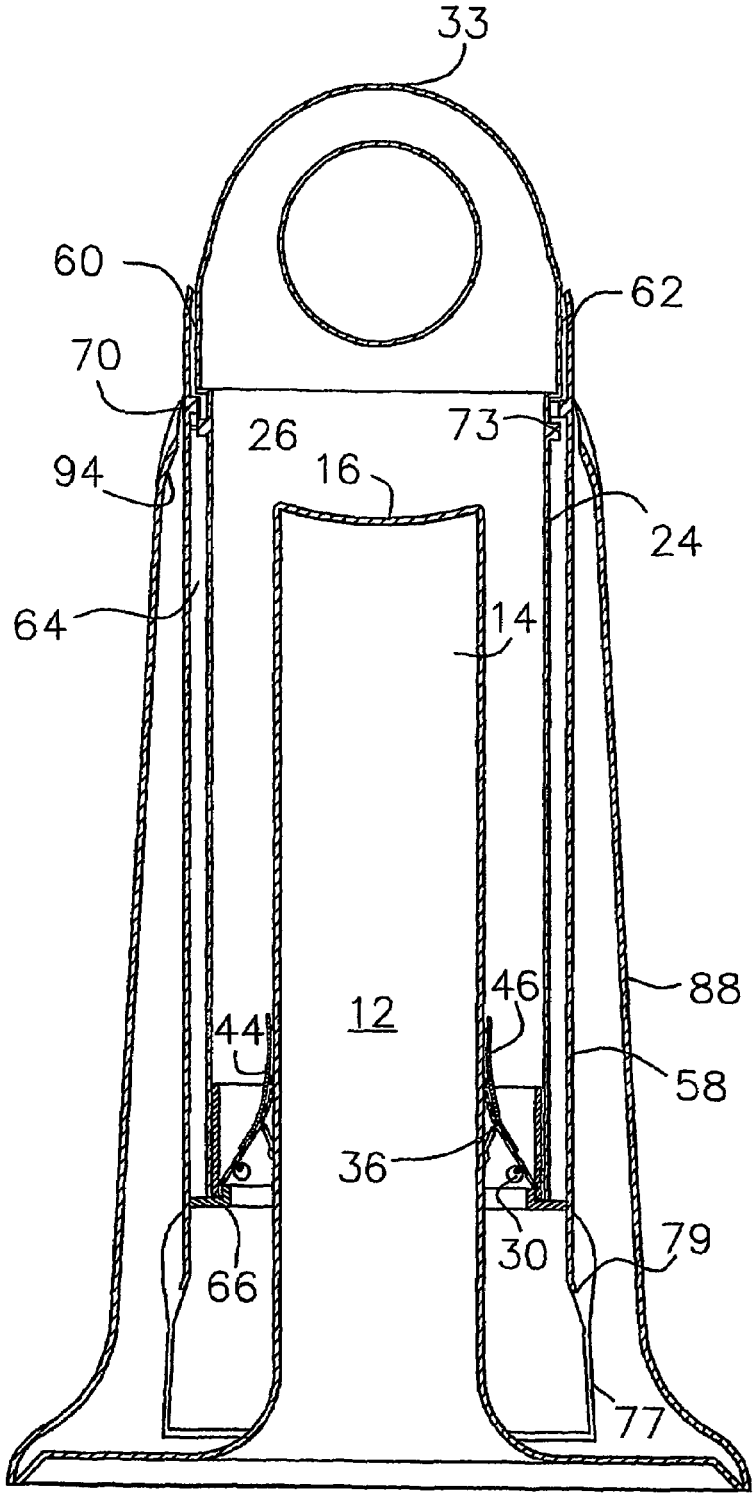
FIG. 5 is a cross-sectional view of FIG. 1 showing the spatial relationship between the casing, cartridge and rod when the rod is in the closed position.
Figure 6:
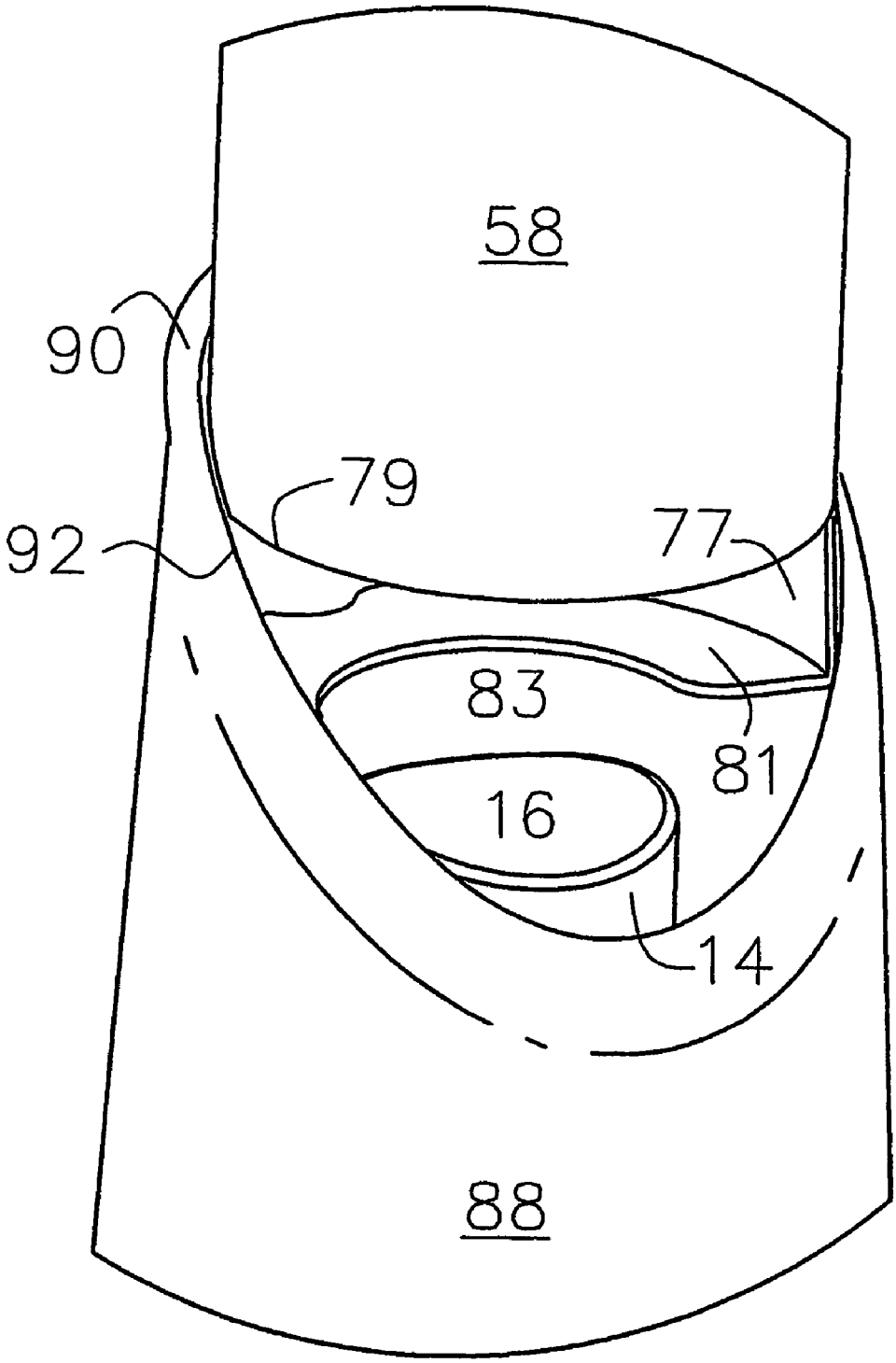
FIG. 6 is a view of the accessible area for depositing the sanitary napkin when the rod is in the open position.
Figure 7:
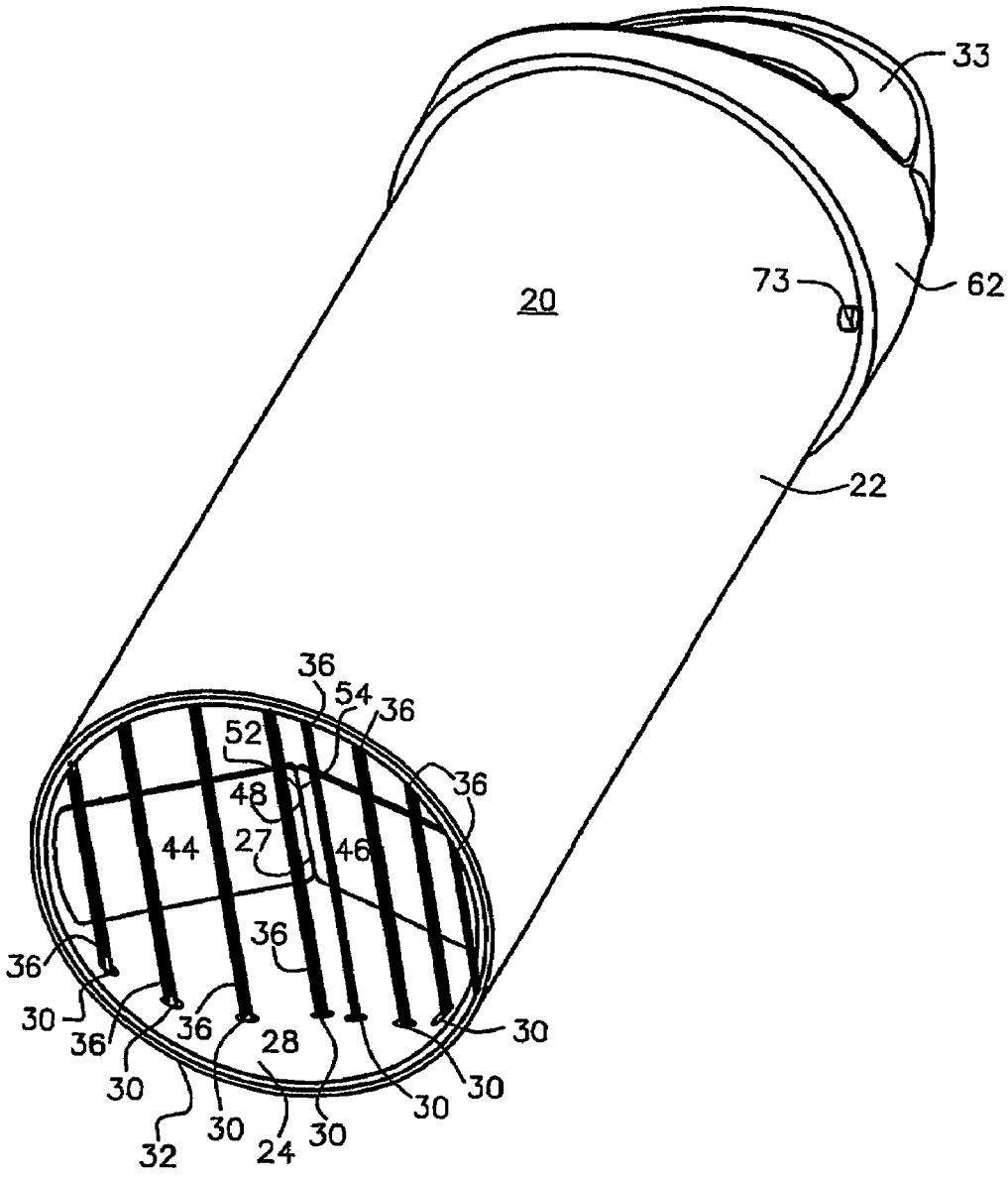
FIG. 7 is a perspective view of the retaining means within the cartridge.

Referring to the figures in detail, a sanitary napkin disposal assembly 10 includes an elongated rod 12 having a substantially cylindrical body 14.

The cylindrical body 14 is closed at one end by a top cover 16 formed integrally with the body 14. The top cover 16 has a planar horizontal form, of general dimensions slightly larger than the surface area required to deposit a standard sanitary napkin 17 thereon.

However, it is to be appreciated by those skilled in the art that the dimensions of the top cover 16 will be relative to the application of the disposal assembly and the sanitary items to be disposed of.

The rod 12 includes a laterally extended ledge 18 at the base of the rod 12. A series of holes 21 along the ledge 18 allows the rod 12 to be mounted in a fixed location. The rod 12, described in one preferred embodiment as shown in FIG. 13, is located on the floor (not shown) of the washroom or bathroom by the pressure applied from the foot of a user of the assembly 10 to the casing 88.

Figure 12:
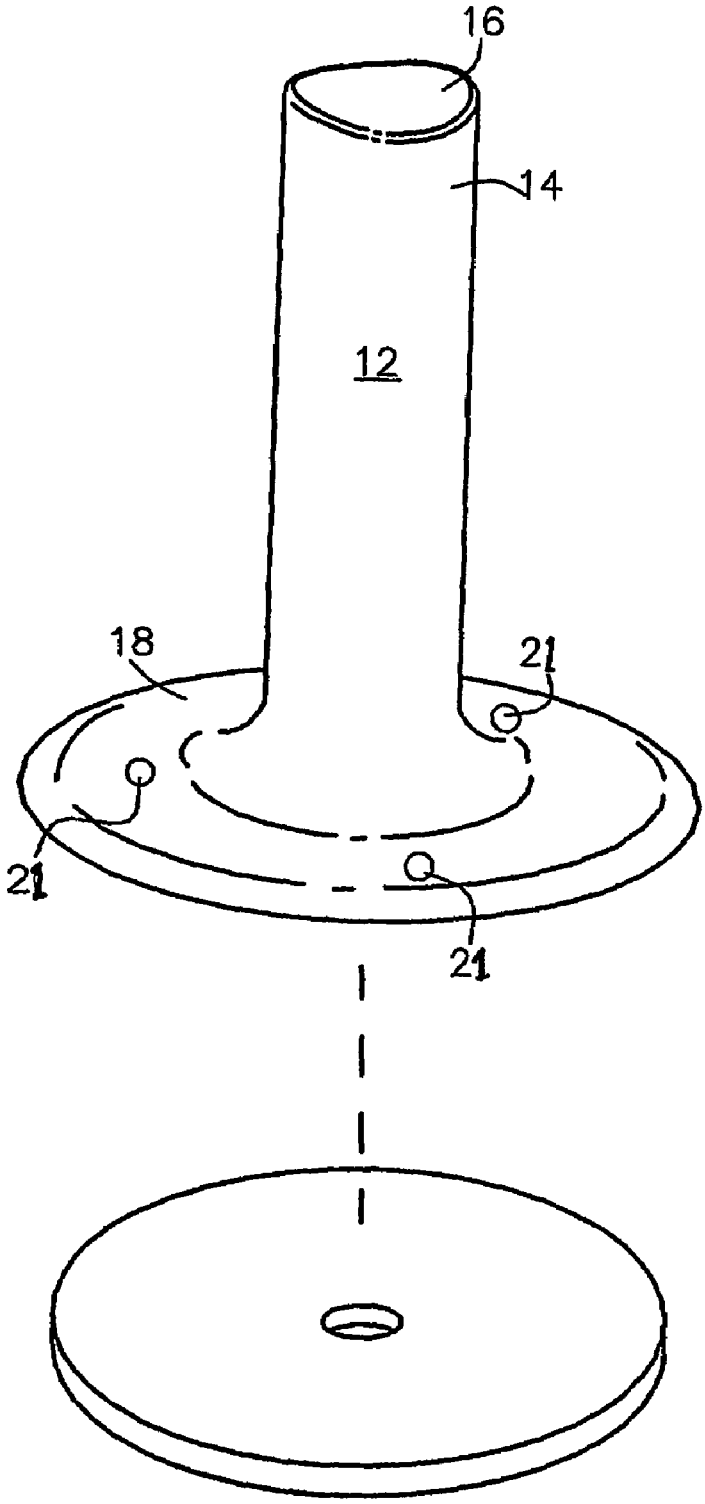
FIG. 12 is a further embodiment of the invention with the rod being fixed to the floor by a weighted ledge.

Alternatively, in a further embodiment as shown specifically in FIG. 12, the ledge 18 is without holes and is deliberately weighted so as to substantially locate the rod in position on the floor of the bathroom. The weighted ledge 18 provides for adequate location so that the rod will not move when the assembly is in operation, but also advantageously does allow portable movement of the assembly, if it was to be then reinstalled in a separate bathroom.

A cartridge 20 having a substantially cylindrical body 22 with an internal wall 24 defines a hollow storage compartment 26.

The cartridge 20 has an opening 28 at one end of the cartridge 20. A handle 33 is located at the other end of the cartridge 20. A user of the sanitary napkin disposal assembly grasps the handle 33 in order to remove the cartridge 20 with respect to the rod 12. The internal peripheral wall 24 of the cartridge 20 is of general dimensions so as to be slideably received over the rod in a friction-less embrace.

The opening 28 of the cartridge 20 includes retaining means.

The retainingmeans has a series of notches 30 on opposingsides of the internal wall 24 of the cartridge The notches 30 are arranged in a series such that each progressive adjacent notch 30, when travelling along line A to B (as shown in broken lines in FIG. 8) is located at a higher vertical distance from an edge 32 at the base of the cartridge 20. At a midway point 25, the progressive adjacent notches 30 are located at a vertical distance closer to the edge 32 of the cartridge 20.

Figure 8:
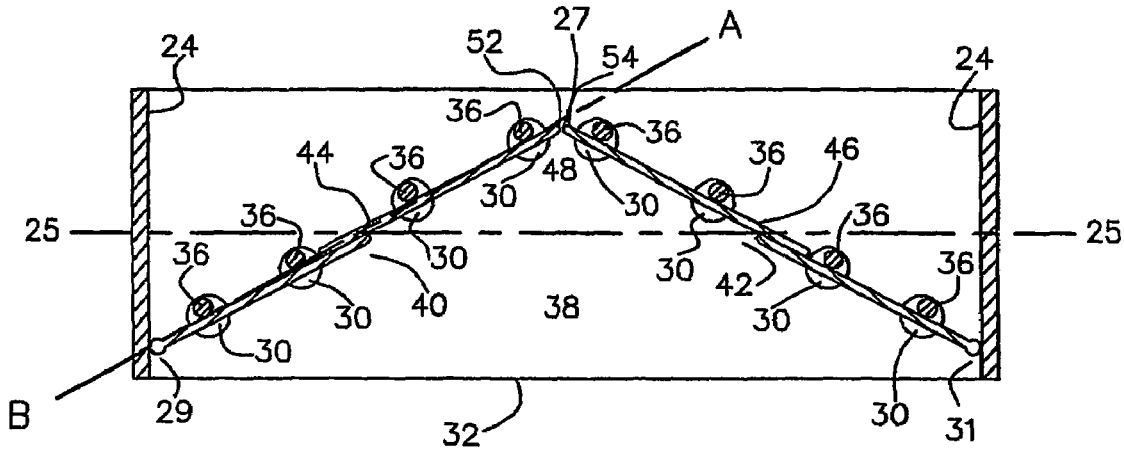
FIG. 8 is a cross-sectional view of the retaining means of FIG. 7.

As shown in FIG. 8, the notches 30 form a triangular pattern with respect to the edge 32 of the cartridge 20. The apex 27 of the triangular pattern formed by the notches 30 on each opposing side of the internal wall 24, is of a greater vertical distance from the edge 32 of the cartridge 20 than the two other respective corners 29,31.

Each notch 30 has a corresponding notch 30 on the opposing side of the internal wall 24. The pair of corresponding notches 30 latches a resilient strip 36. The strips 36 form a skeletal triangular prism structure 38. Supported midway along each respective side 40, 42, of the triangular prism 38 are panels 44, 46 forming a pointed seat 48 when in the capturing position.

The aforesaid described retaining means allows a disposable bag 50 to be supported in the storage compartment 26. The retaining means also provides for a closure means whereby the sanitary item 17 is unimpeded from being inserted up into the internal storage compartment 26 into the disposable bag 50 as the rod 12 slideably receives the cartridge 20 when the rod 12 enters into the closed position within the storage compartment 26.

The dimensions of the cartridge 20 and the storage compartment 26 are such that when the rod 12 is in the closed position, the sanitary napkin 17 is forced to be compressed down in size, providing for a smaller volume of overall waste to be disposed of back into the environment.

The panels 44, 46 of the pointed seat 48 by virtue of the forward biasing of the strips 36 in the triangular prism arrangement, allow passage through the opening 28 into the storage compartment 26. Reverse passage out of the storage portion 24 is not permitted for the contents of the disposable bag 50, as the top edges 52, 54, of each respective panel 44, 46, collapse back into the pointed seat 48 arrangement.

The return of the panels 44, 46, into the pointed seat 48 arrangement is brought about by the biasing of the strips 36 to return to the unstressed position with respect to notches 30, which latch each strip 36 to the corresponding notch on each side of the internal wall 24 of the cartridge 20.

The cartridge 20 is slideably mountable in a sleeve 58. The sleeve 58 is of comparable dimensions to the cartridge 20 so as an internal chamber wall 60 of the sleeve 58 is adapted to encapsulate an outer surface 62 of the cartridge 20. The encapsulated cartridge 20 includes a void 64 between the internal chamber wall 60 of the sleeve 58 and the outer surface 62 of the cartridge 20.

The void 64 is of general dimensions to allow the disposable bag 50 to be freely moveable down the void 64, and then subsequently up into the internal storage compartment 26 of the cartridge 20, as the rod 12 is pushed into the closed position. The void 64 allows the movement and unfolding of the disposable bag 50 without any substantial impediment, that would cause the bag 50 to become damaged.

At the base of the sleeve 58 a collar 66 laterally extends around the internal 10 chamber wall 60 to accommodate an abutting fit with a top peripheral edge 68 of the cartridge 20 when the sleeve 58 is fastened to the cartridge 20.

A flange 70 encircles an upper internal perimeter of the sleeve 58. The flange 70 includes a partition groove 72 along the flange 70 length. The cartridge 20 has a protruding tab 73 that extends out of the outer surface 22 of the cartridge.

Figure 9A:
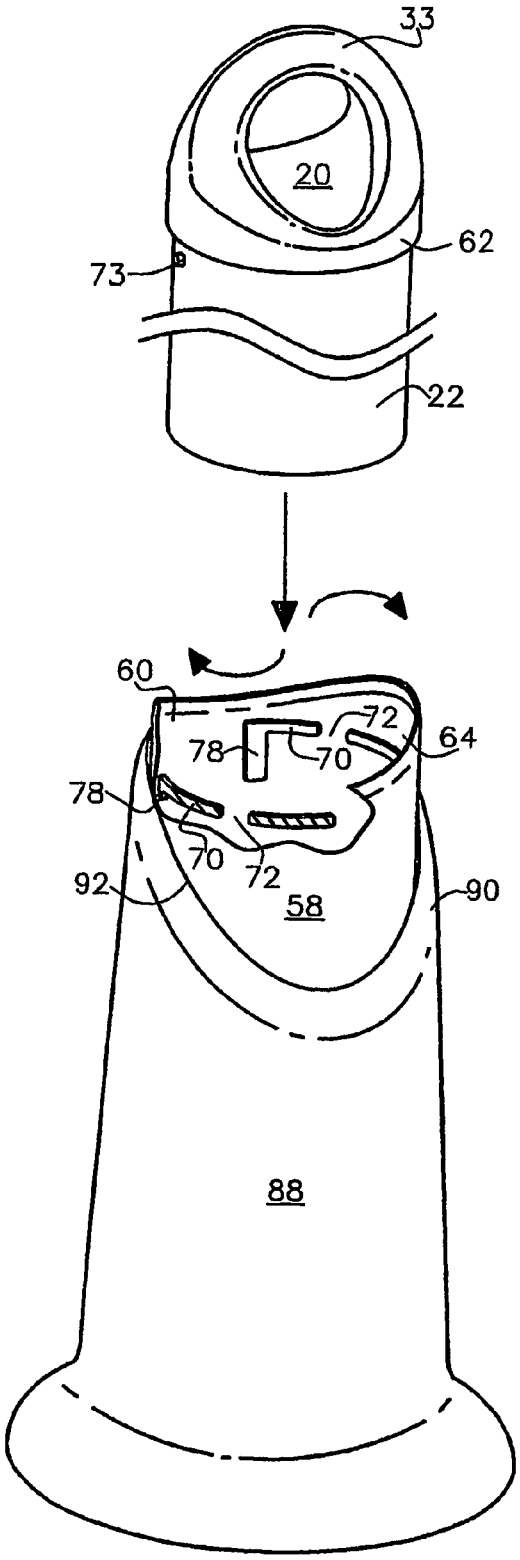
FIGS. 9*a* and 9*b* are part cut out perspective views of the cartridge being securely fastened to the sleeve.
Figure 9B:
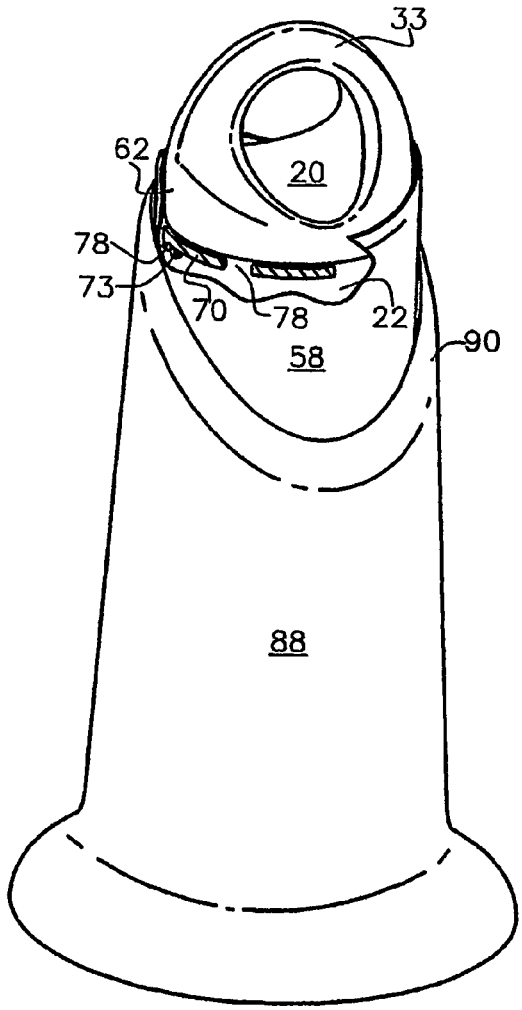

As seen in FIGS. 9*a* and 9*b*, the cartridge 20 is rotated so that tab 73 extending from cartridge 20 aligns with the partition groove 72. The tab 73 is moved down into the groove and with further rotation thereafter abuts shoulder 78 of the flange 70.

The sleeve 58 is then fastened to the cartridge 20 by the abutment of the tab 73 with the shoulder 78 of flange 70, which encircles the upper internal perimeter of the sleeve 58, while at the other end of the sleeve 58, collar 66 is in an abutting engagement with the top edge 68 of the cartridge 20, thereby releasably securing the sleeve 58 and cartridge 20 with respect to each other.

The sleeve 58 includes a skirt 77 that laterally extends out from a portion at the base 79 of the sleeve. A lip 81 longitudinally extends out from the skirt 77. The lip 81 has an interior panel 82 that provides for an accessible containment space 83 with the top cover 16 of the rod 12 for the positioning of the sanitary napkin 17 on the rod 12.

An external casing 88 is formed separately from the cartridge 20 and the rod 12. The casing 88 is of substantially cylindrical form and of the same general outer dimensions as the sleeve 58 when mounted to the cartridge 20. The casing 88 is fixed to the floor and includes a shoulder 90 that runs completely around an upper peripheral rim 92 on an underside 94 of the casing 88. The shoulder 90 is of sufficient width so as to abut the laterally extended skirt 77 extended around the base 79 of the sleeve 58.

Figure 10A:
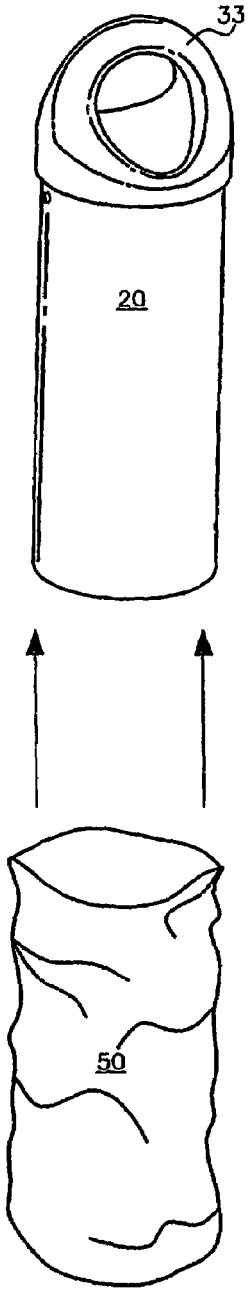
FIGS. 10*a* and 10*b* are perspective views of the installation of the disposable bag into the sanitary napkin disposal assembly.
Figure 10B:
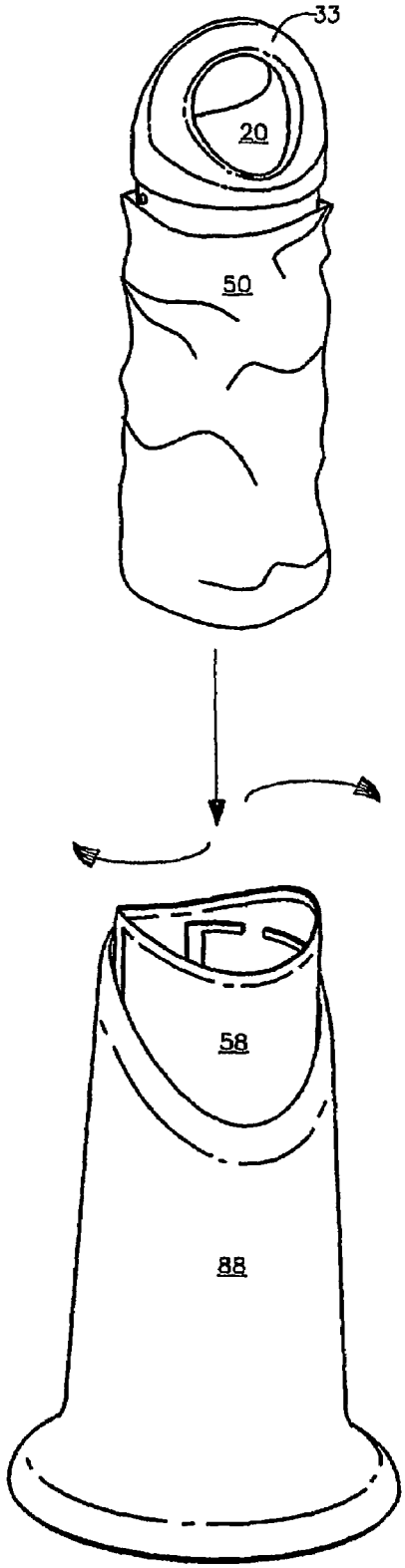

Referring to FIGS. 10*a* and 10*b* the disposable bag 50 is inserted into the cartridge 20, by unfastening the sleeve 58 through rotating the cartridge 20 so that the tab 73 is passable through the partition groove 72. The disposable bag 50 is placed into the open end 28 of the cartridge 20 and then with the re-fastening of the sleeve 58 with respect to cartridge 20 void 64 is created. The void 64 accommodates the sides 92, 94 of the bag 50. The cartridge 20 is then inserted over the rod 12 and the driving force of the rod 12 up into the storage compartment 26 unfolds the disposable bag 50 in a longitudinal extended action.

The bag 50 while being inserted over the rod 12 is turned inside out. The sides 92, 94 of the bag 50 once having been turned inside out during the insertion over the rod 12, subsequently then form the internal surface of the bag 50 within the cartridge 20.

Figure 11A:
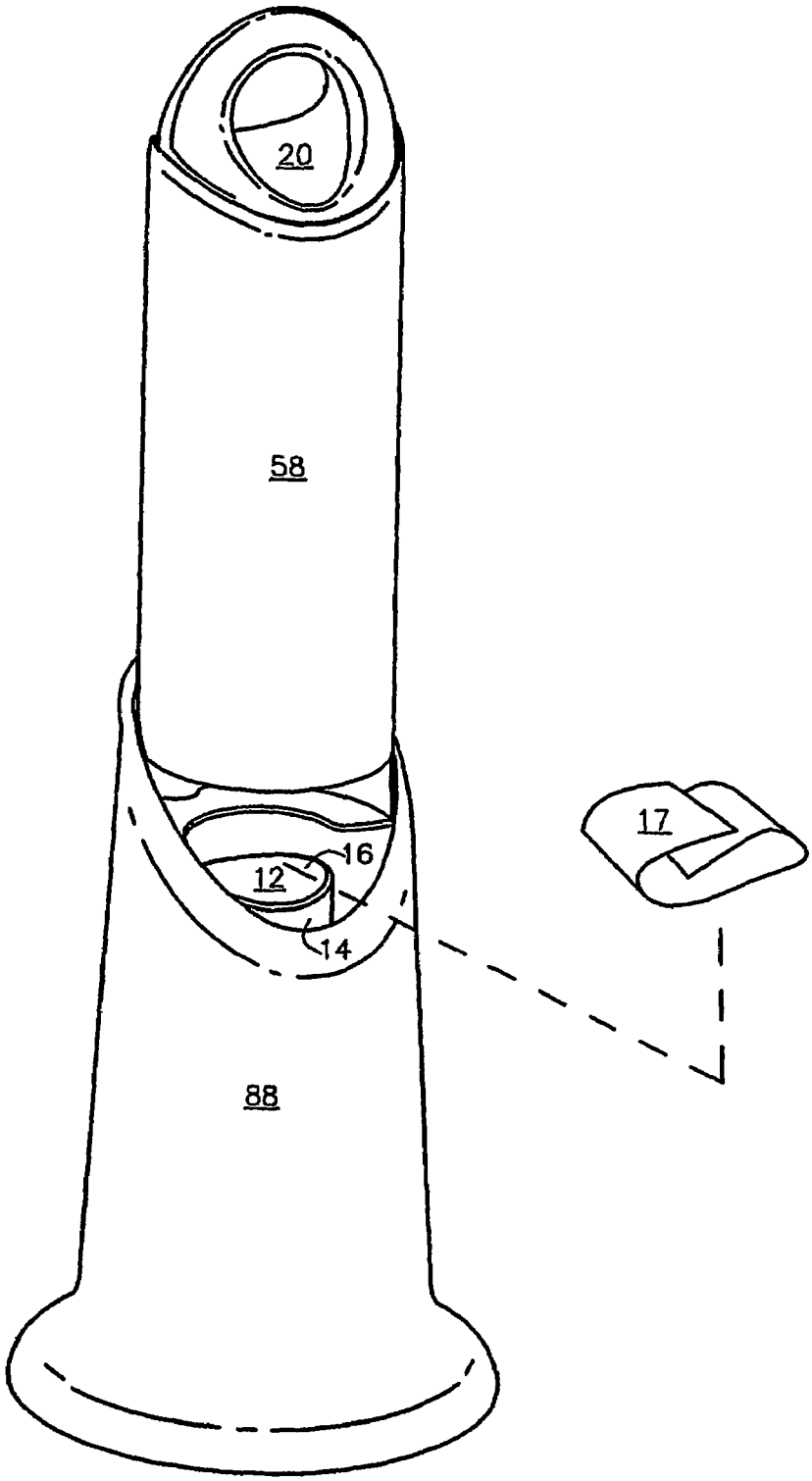
FIGS. 11*a*, 11*b*, and 11*c* are perspective views of the sanitary napkin disposal assembly in use.
Figure 11B:
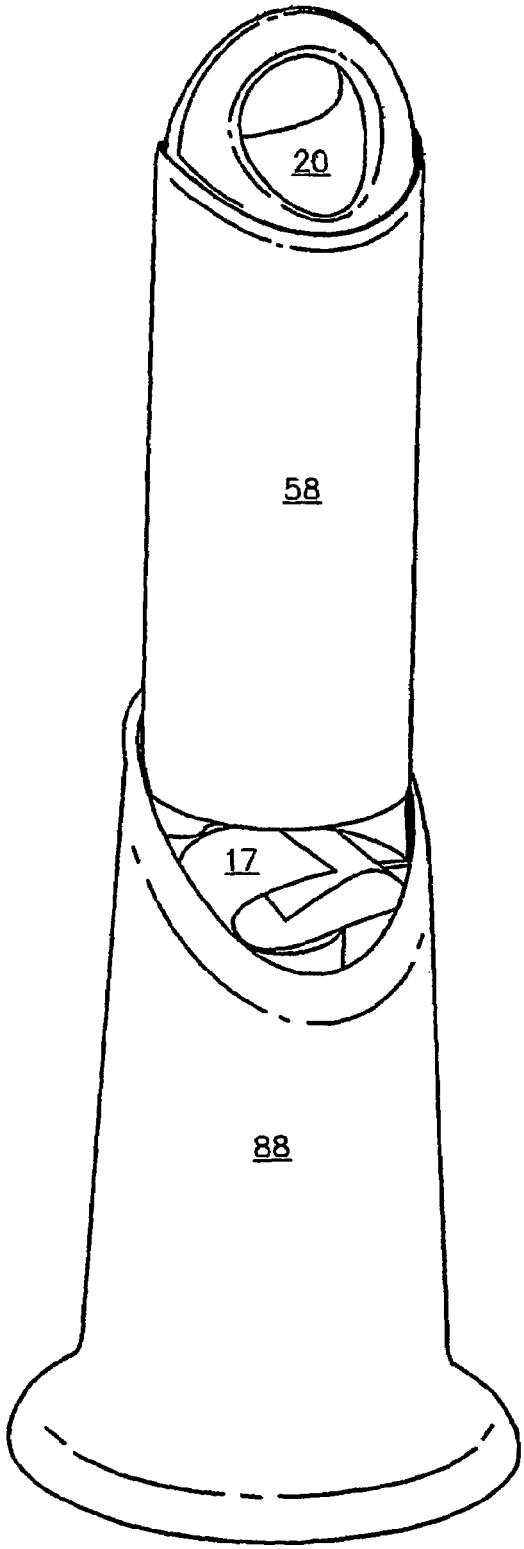
Figure 11C:
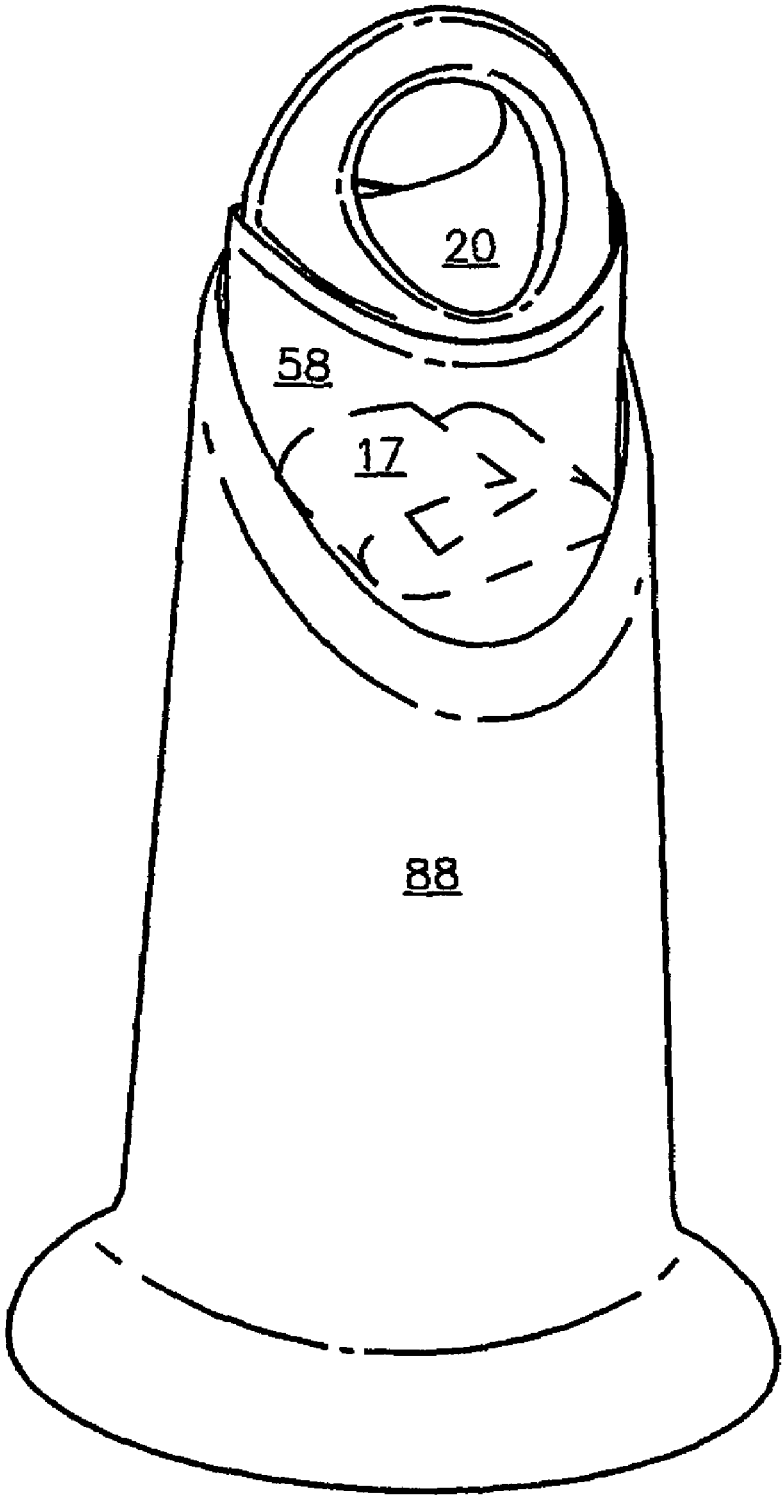

Referring to FIGS. 11*a*, 11*b* and 11*c* a sanitary napkin is disposed of by a user, through grasping the handle 28. The cartridge 20 is then slideably lifted away from the fixed ledge 18 of the rod 12.

The sliding away of cartridge 20 with respect to the rod 12 is interrupted by the abutment of shoulder 90 of casing 88 with the laterally extended skirt 77 of the sleeve 58.

As the shoulder 90 and skirt 77 are in abutting engagement, the accessible space 83 defined by the internal panel 82 of lip 81 is accessible for the sanitary napkin 17 to be placed thereon.

When the sanitary napkin 17 is positioned on the top cover 16 of the rod 12, the cartridge 20 is then allowed to be slideably returned back over the rod 12.

The rod 12 having the sanitary napkin 17 on the top cover 16 pushes panels 44, 46 apart and moves into the disposable bag 50, located in the storage compartment 26. The panels 44, 46 remain forceably open by the rod 12. The biasing force of the panels 44, 46 on the cylindrical body 14 of the rod 12 keeps the contents of the disposable bag 50 sealed.

When a further sanitary item is to be disposed of the aforesaid process repeats. However, during the abutting engagement between the shoulder 90 and skirt 77 to expose the accessible space 83, for depositing a further sanitary napkin, though the rod 12 is no longer involved in sealing the disposable bag 50, the panels 44, 46 by. virtue of the biasing strips 36 still return to the configuration of the pointed seat 48.

The pointed seat 48 impedes any reverse flow of the contents of the disposable bag 50 out of the cartridge 20, while a subsequent sanitary napkin is being disposed of within the assembly 10.

Figure 13A:
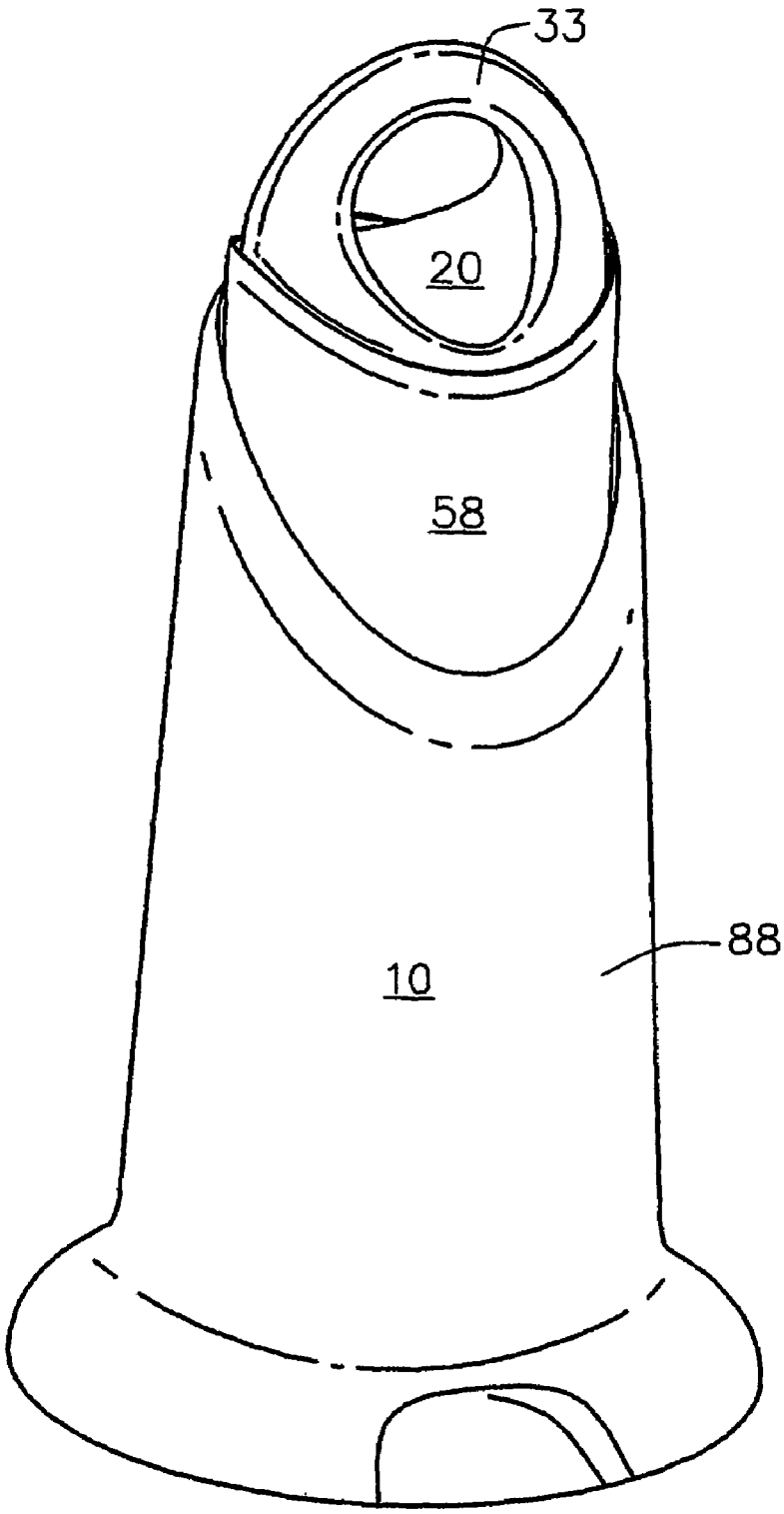
FIGS. 13*a* and 13*b* are examples of a further embodiment of the invention with the foot of a user providing the fixing of the assembly to the floor.
Figure 13B:
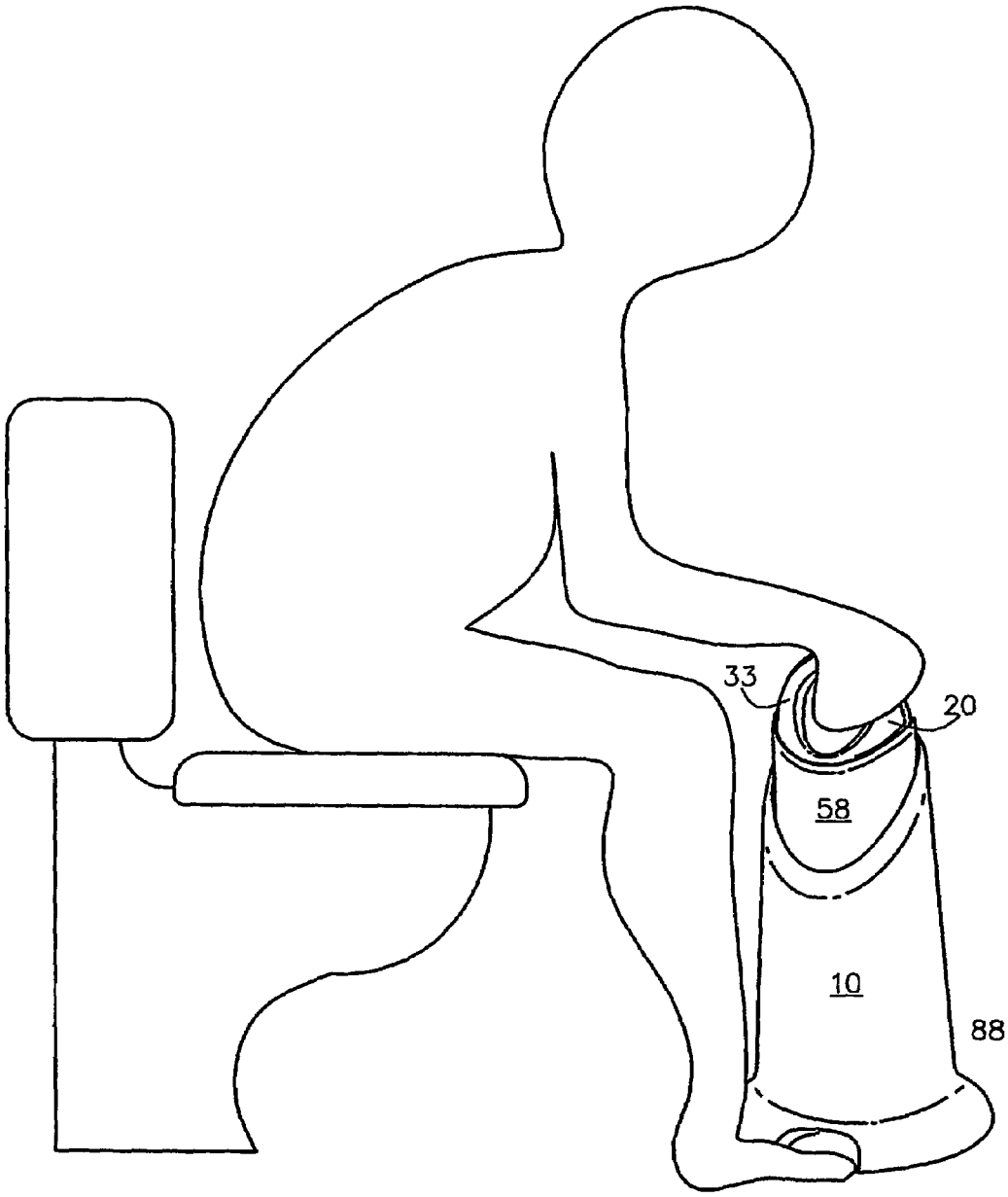

Referring to FIGS. 13*a* and 13*b*, the rod 12 and casing 88 is fixed to the floor (not shown) of the washroom or bathroom by the pressure applied from the foot of a user of the assembly 10.

It is to be appreciated by a person skilled in the art, that numerous variations and/or modifications may be made to this invention as shown in these specific embodiments without departing from the scope of the invention as described above.

Therefore, the present embodiments are to be considered in all respects as illustrative but not restrictive. Particularly, it can be appreciated that a variety of shapes may be available for the respective casings, cartridge and rod. The assembly, for example, would be just as effective if the formation was substantially tetrahedral. It is also important to note that the retaining means provides for unimpeded delivery into the storage compartment, which is occupied by a disposable bag, while at the same time prevents reverse flow thereout of the deposited sanitary item. The retaining means in the preferred embodiment is provided for by biasing strips supporting a pointed seat.

It is to be appreciated that though the preferred embodiment describes one particular arrangement, other biasing arrangements may well be equally suitable. It is the intention of this description to incorporate such other comparable arrangements.

The invention claimed is:

1. A sanitary napkin disposal assembly, said assembly including:

a cartridge having an internal storage compartment with an opening at one end, with means for retaining and supporting a bag within the storage compartment; and a rod;

the assembly having an open position in which the rod is not housed within the storage compartment in which a top surface of the rod is accessible and exposed, and the assembly having a closed position in which the rod is housed within the storage compartment, such that when a sanitary napkin is disposed of by being placed on the top surface of the rod in the open position, with the bag subsequently unfolding in a longitudinal extending action into the storage compartment, the retaining means captures the sanitary napkin within the bag as the assembly moves to the closed position.

2. The sanitary napkin disposal assembly of claim 1 wherein the cartridge is removably attached to the rod.

3. The sanitary napkin disposal assembly of claim 2 wherein the rod is in a fixed position.

4. The sanitary napkin disposal assembly of claim 3 wherein the rod is fixed to the floor of a bathroom or a public washroom facility.

5. The sanitary napkin disposal assembly of claim 4 further including a slide-able sleeve mountable around an exterior surface of the cartridge, wherein the sleeve and the cartridge are provided with means for securing and engaging, formed integrally with respective to the sleeve and cartridge.

6. The sanitary napkin disposal assembly of claim 5 wherein the sleeve includes an encircling flange at an upper internal perimeter.

7. The sanitary napkin disposal assembly of claim 6 wherein the flange includes a partition groove along the flange length adapted to receive an outwardly extended tab protruding from the cartridge wherein rotation of the cartridge relative to the sleeve brings the tab into cooperation with the groove and with vertical applied movement the tab is able to pass through the groove, and with further rotation abuts a shoulder of the flange for releasable securement of the sleeve to the cartridge.

8. The sanitary napkin disposal assembly of claim 7 wherein the sleeve includes an internal collar around the base of the sleeve.

9. The sanitary napkin disposal assembly of claim 8 wherein the collar accommodates an abutting fit with a top peripheral edge of the cartridge.

10. The sanitary napkin disposal assembly of claim 9 wherein the sleeve includes a skirt that laterally extends out from a portion at the base of the sleeve.

11. The sanitary napkin disposal assembly of claim 10 wherein a lip longitudinally extends in a substantially parallel direction as that of the sleeve from the skirt, such that when the rod is in the open position, an interior panel of the lip provides for an accessible containment space with the top cover of the rod for the positioning of the sanitary napkin on the rod.

12. The sanitary napkin disposal assembly of claim 11 wherein the cartridge includes a handle at the end opposite the opening into the storage compartment whereby the handle can be grasped by a user, such that the cartridge is conveniently slideably removable from the rod, to provide the opening and closing positions of the assembly with respect to the cartridge.

13. The sanitary napkin disposal assembly of claim 12 wherein the handle is integral with the cartridge.

14. The sanitary napkin disposal assembly of claim 13 wherein the retaining means includes two separate panels extended from opposing sides of an interior wall of the cartridge.

15. The sanitary napkin disposal assembly of claim 14 wherein the panels are supported by a plurality of resilient strips.

16. The sanitary napkin disposal assembly of claim 15 wherein the plurality of resilient strips maintain each panel in an inwardly inclined orientation, such that a forward end of each panel is separable from the other, as the rod is inserted into the open end of the cartridge, whereby while the rod is in the open position the two panels remain in a pointed seat arrangement.

17. The sanitary napkin disposal assembly of claim 16 wherein the sanitary napkin disposal assembly further includes an external casing formed separately from the cartridge and the rod.

18. The sanitary napkin disposal assembly of claim 17 wherein the casing is substantially cylindrical and of the same general outer dimensions as the sleeve when mounted to the cartridge.

19. The sanitary napkin disposal assembly of claim 18 wherein the casing is fixed to the floor and includes a shoulder that runs completely around the upper peripheral rim of the underside of the casing and wherein the shoulder is of sufficient width so as to abut the laterally extended skirt extended around a portion, at the base of the sleeve.

20. The sanitary napkin disposal assembly of claim 19 wherein corresponding longitudinally aligned transparent slits are located along the length of the respective casing, sleeve and cartridge.

21. The sanitary napkin disposal assembly of claim 20 wherein the cartridge is slideably mountable to the sleeve with the sleeve of comparable dimensions to the cartridge, so as an internal chamber wall of the sleeve is adapted to encapsulate an outer surface of the cartridge such that the encapsulated cartridge includes a void between the internal chamber wall of the sleeve and the outer surface of the cartridge.

22. The sanitary napkin disposal assembly claim 21 wherein the void is of general dimensions to allow a disposable bag to be freely moveable down the void, and then subsequently up into the internal storage compartment of the cartridge, as the assembly is pushed into the closed position.

* * * * *